US006764335B2

(12) United States Patent
Ichio

(10) Patent No.: US 6,764,335 B2
(45) Date of Patent: Jul. 20, 2004

(54) CONNECTOR

(75) Inventor: Toshifumi Ichio, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/364,957

(22) Filed: Feb. 11, 2003

(65) Prior Publication Data

US 2003/0157834 A1 Aug. 21, 2003

(30) Foreign Application Priority Data

Feb. 15, 2002 (JP) ..... 2002-038683

(51) Int. Cl.[7] ..... H01R 13/40
(52) U.S. Cl. ..... 439/595; 439/489
(58) Field of Search ..... 439/595, 489, 439/533, 752, 594, 951

(56) References Cited

U.S. PATENT DOCUMENTS 5,769,663 A * 6/1998 Kodama ..... 439/595

FOREIGN PATENT DOCUMENTS

JP 2001-297816 10/2001

* cited by examiner

*Primary Examiner*—Alex Gilman
(74) *Attorney, Agent, or Firm*—Anthony J. Casella; Gerald E. Hespos

(57) ABSTRACT

A connector has a housing (10) with cavities (11) for receiving terminal fittings (21). Each cavity (11) has a lock (12) with a fastening portion (13) for locking the terminal fitting (21). A jig contact portion (14) is formed at the side of the fastening portion (13). A withdrawing jig (J) comes into sliding contact with the jig contact portion (14) to deform the lock (12) away from the terminal fitting (21) to cancel the locked state. The front end (14F) of the jig contact portion (14) is more backward than the front end (13F) of the fastening portion (13). Thus, a stroke of the sliding-contact accompanied by frictional resistance between the withdrawing jig (J) and the jig contact portion (14) is shortened, and frictional resistance is reduced during the insertion of the withdrawing jig (J).

12 Claims, 9 Drawing Sheets

CONNECTOR

BACKGROUND OF THE INVENTION

1. Field of the Invention

The invention relates to a connector with locks for locking terminal fittings.

2. Description of the Related Art

Japanese Unexamined Patent Publication No. 2001-297816 discloses a connector with a housing that has opposite front and rear ends and cavities that extend between the ends. The connector also includes terminal fittings that can be inserted into the respective cavities. A lock projects forward along an inner wall of each cavity and is supported at only at one end. The lock interferes with the outer surface of the terminal fitting as the terminal fitting is inserted into the cavity. Thus, the lock resiliently deforms and retracts from the insertion path of the terminal fitting. However, the lock resiliently returns and engages the terminal fitting when the terminal fitting reaches a proper insertion position.

The front end of each lock defines a fastening portion that engages the terminal fitting from behind. Further, a jig contact portion is formed at the side of the fastening portion and has a sliding-contact surface corresponding to each terminal fitting. The locked terminal fitting can be withdrawn from the housing by inserting a jig into the housing from the front. The jig then is slid on the sliding contact surface of the jig contact portion to deform the lock away from the terminal fitting. Thus, the locked state is canceled, and the terminal fitting may be withdrawn backward while the lock is held in the unlocked state.

However, frictional resistance generally is large during withdrawal of the withdrawing jig.

The present invention was developed in view of the above problem and an object thereof is to improve operability of a withdrawing jig.

SUMMARY OF THE INVENTION

The invention relates to a connector with a housing formed with at least one cavity and at least one terminal fitting that is insertable into the cavity from behind. A lock is cantilevered forwardly along an inner wall of the cavity and is resiliently deformable to exit an insertion path for the terminal fitting. A fastening portion is defined at the front of the lock for locking the terminal fitting by engaging the terminal fitting from behind. At least one jig contact portion is formed in proximity to the fastening portion of the lock. Thus, a withdrawing jig can be inserted into the housing from the front, and slides in contact with the jig contact portion. Thus, the lock is deformed in a direction to disengage from the terminal fitting, thereby canceling the locked state. The front end of the jig contact portion is spaced from the front end of the fastening portion along the jig insertion direction.

The withdrawing jig starts sliding on the jig contact portion later during its inserting process as compared with a case where the front end of the jig contact portion is at the same position as the fastening portion. Thus, there is a shorter stroke of sliding-contact accompanied by frictional resistance between the withdrawing jig and the jig contact portion. Accordingly, frictional resistance is reduced, and excellent operability of the withdrawing jig can be realized.

The jig contact portion preferably is formed at the side of the fastening portion of the lock.

The fastening portion preferably projects more toward a withdrawing jig insertion path than the jig contact portion, and a side surface of a projecting part of the fastening portion serves as a guiding surface for the withdrawing jig. Thus, the withdrawing jig is guided by the guiding surface before reaching the jig contact portion and is prevented from loose movements. As a result, the withdrawing jig can be inserted stably.

The front end surface of the fastening portion preferably slopes back from a locking end thereof toward the front end of the jig contact portion. The withdrawing jig could be displaced sideways from a proper position and could strike against the fastening portion. However, the jig would be guided away from the terminal fitting by the inclination of the front surface of the fastening portion and will not contact the terminal fitting.

The housing has a deformation permitting space for permitting the lock to be deformed away from the terminal fitting. A surface of the lock that faces the deformation permitting space preferably is slanted. Thus, the fastening portion and the jig contact portion gradually thin toward the front end of the lock.

A necessary and minimum distance between the lock in an unbiased state and the inner wall of the deformation permitting space is so set that the front edge of the surface of the lock facing the deformation permitting space does not interfere with the inner wall of the deformation permitting space when the lock is disengaged from the terminal fitting. However, in this invention, the surface of the lock facing the deformation permitting space is sloped to be more distanced from the inner wall of the deformation permitting space toward the front. Therefore, even if the distance from the inner wall of the deformation permitting space to the lock is smaller, a larger degree of resilient deformation of the lock can be ensured.

The front end of the jig contact portion preferably is at the same position as the front end of the slanted surface. Thus, the front end of the jig guiding surface and the front end of the slanted surface meet to form an acute angled edge.

The sum of the width of the fastening portion and of the jig contact portion(s) preferably exceeds the width of the cavity.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
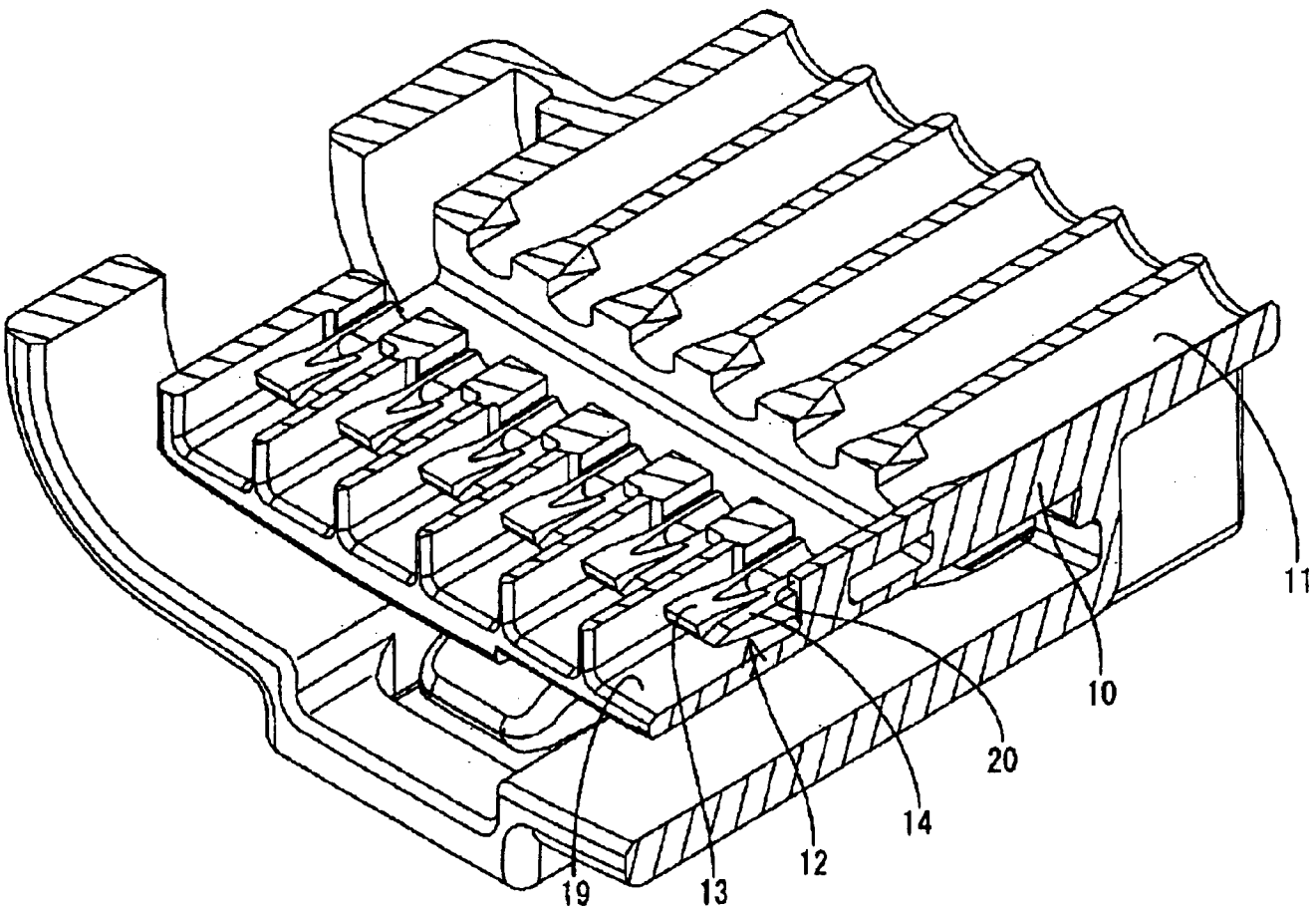
FIG. 1 is a partial perspective view partly in section showing a connector according to a first embodiment of the invention.
Figure 2:
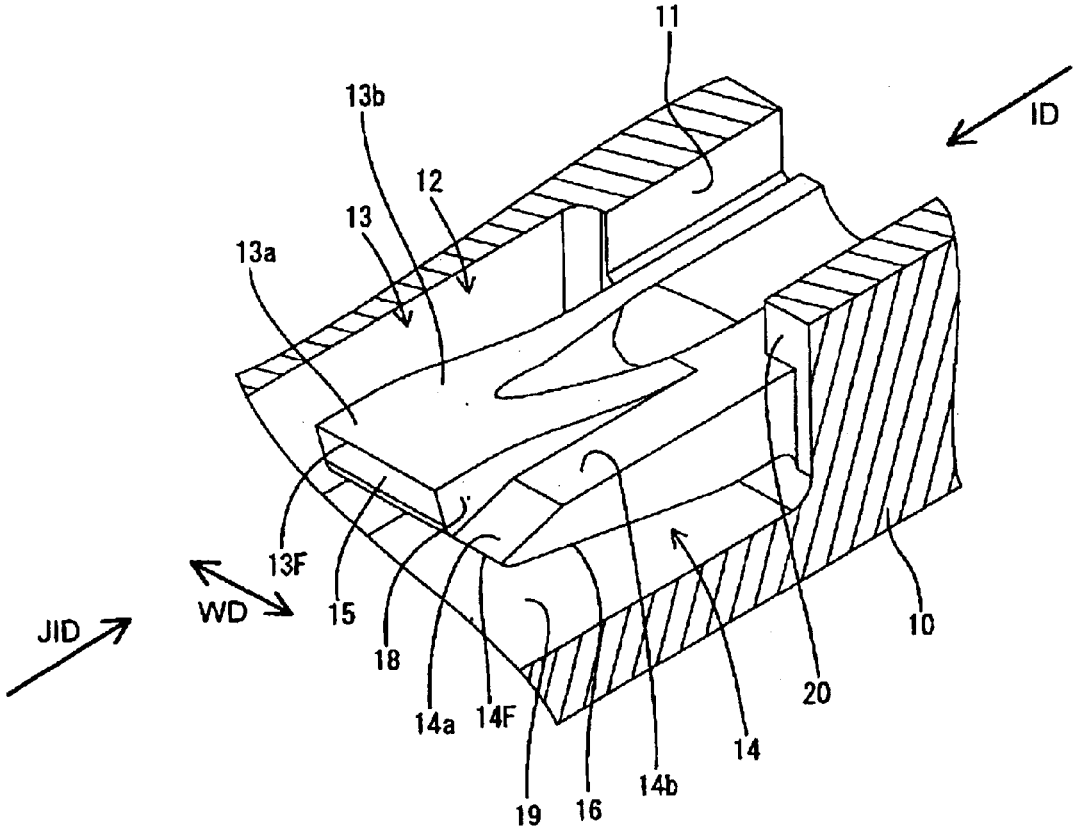
FIG. 2 is an enlarged perspective view of a lock.
Figure 3A:
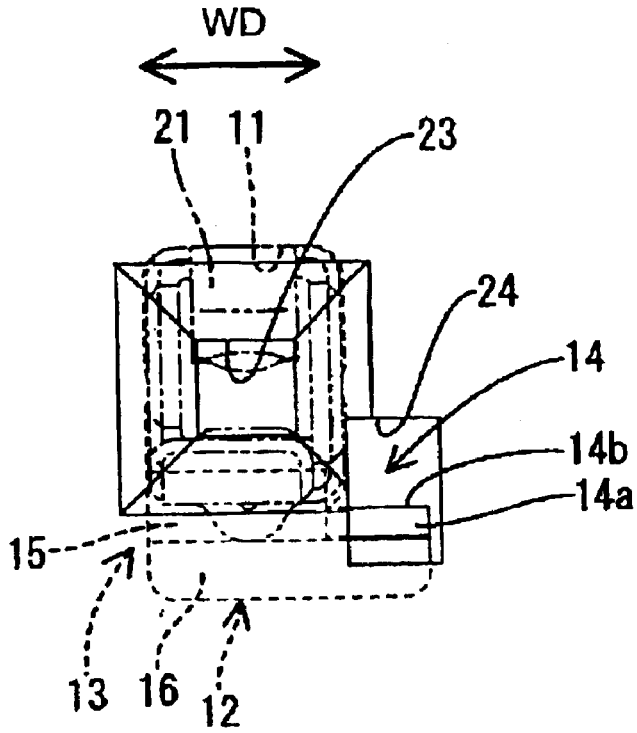
FIG. 3(A) is a partial front view showing a positional relationship between a cavity, the lock and a terminal fitting.
Figure 3B:
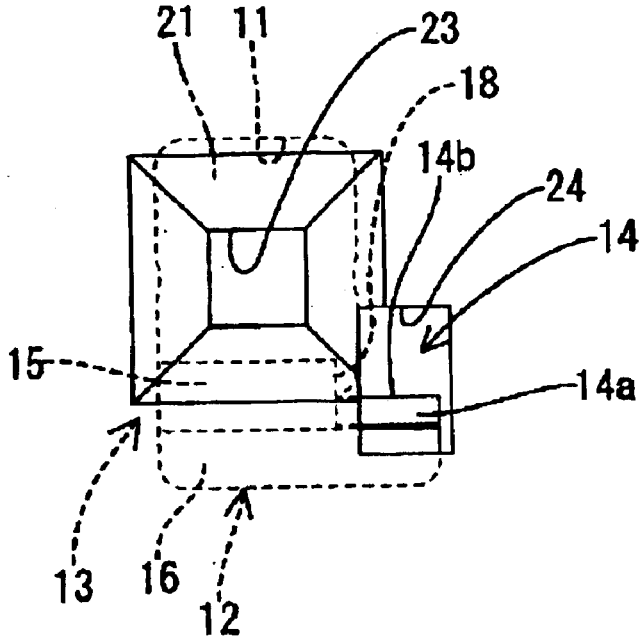
FIG. 3(B) is a partial front view showing a positional relationship between the cavity and the lock.
Figure 4A:
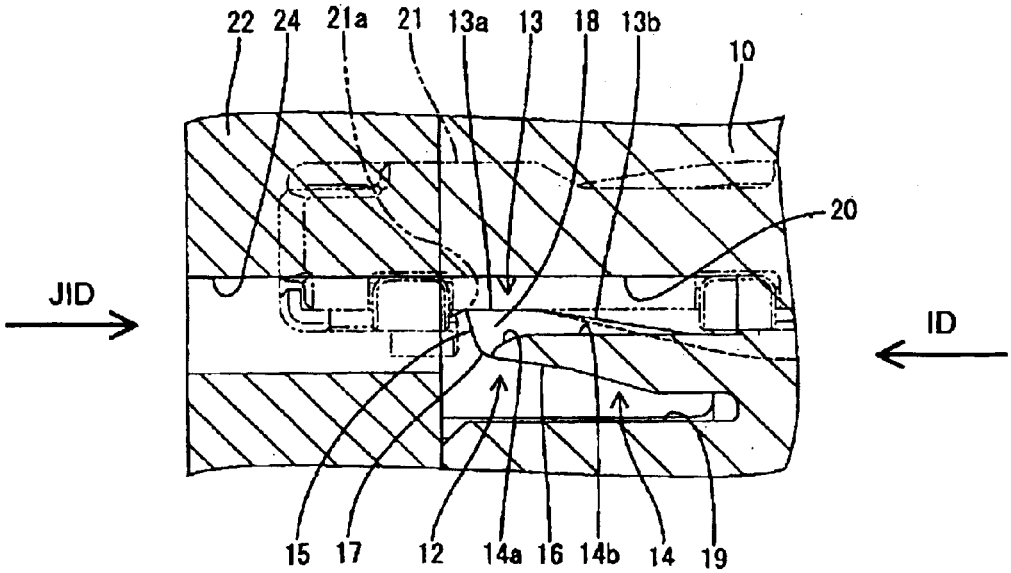
FIG. 4(A) is a longitudinal sectional view showing a positional relationship between the terminal fitting, an insertion path of a withdrawing jig and the lock.
Figure 4B:
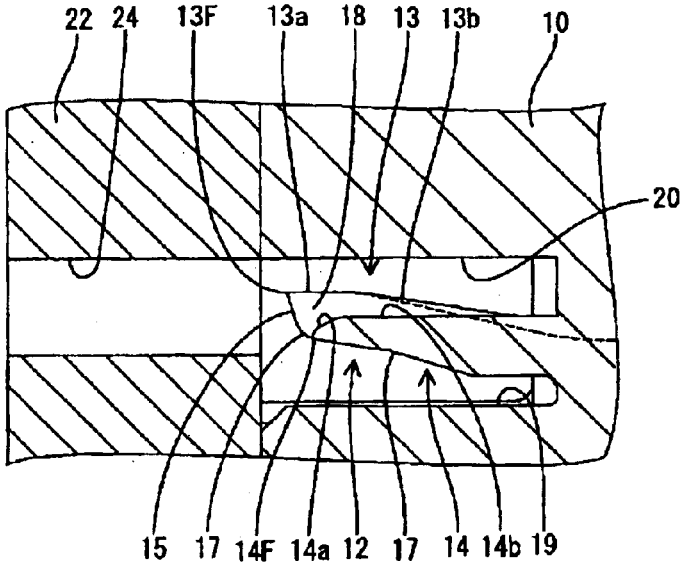
FIG. 4(B) is a longitudinal sectional view showing a positional relationship between the insertion path for the withdrawing jig and the lock.
Figure 5A:
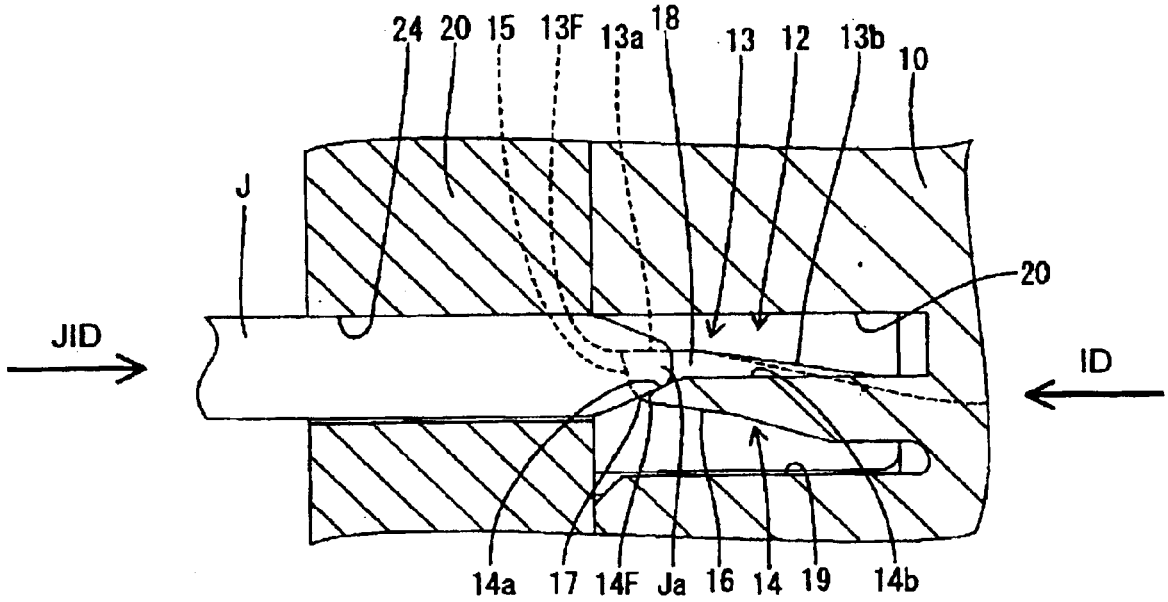
FIG. 5(A) is a longitudinal sectional view showing a state where the inserted withdrawing jig comes into contact with the jig contact portion of the lock.
Figure 5B:
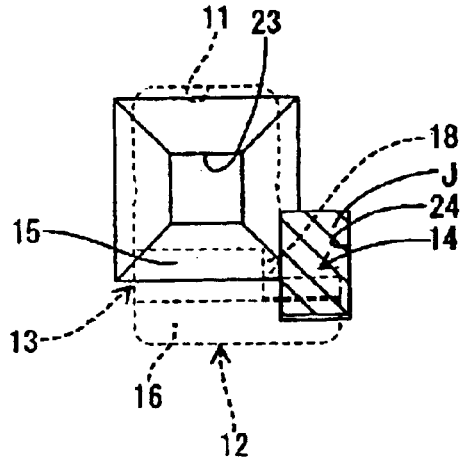
FIG. 5(B) is a partial front view showing a state where the withdrawing jig is inserted.

A connector according to a first embodiment of the invention is described with reference to FIGS. 1 to 7. The connector of this embodiment has a housing 10 formed e.g. of a synthetic resin. The housing 10 has opposite front and rear ends, and cavities 11 of substantially rectangular cross-section extend between the ends. Terminal fittings 21 can be inserted from behind into the respective cavities 11 by moving the terminal fittings 21 along inserting directions ID of the respective cavities 11. Each cavity 11 is formed with a resiliently deformable lock 12 that is cantilevered forwardly along a wall of the cavity 11. Deformation permitting spaces 19 are formed at the front end of the housing 10 and permit the locks 12 to be deformed down in the deformation direction DD and away from the corresponding cavities 11. Insertion spaces 20 also are formed at the front end of the housing 10 and communicate with the corresponding deformation permitting spaces 19. The insertion spaces are configured to receive a withdrawing jig J.

Each lock 12 has a wide fastening portion 13 and a jig contact portion 14 at the side of the fastening portion 13. The fastening portion 13 is formed over more than ¾ the width of the cavity 11, as measured along the width direction WD in FIG. 3A, and preferably is more than ⅘ the width of the cavity 11. More particularly, the fastening portion 13 extends substantially from one side of the cavity 11 to a position spaced slightly in from the opposed side of the cavity 11 in FIG. 3. The jig contact portion 14 extends transversely from the fastening portion 13 to a position more outward from the right side of the cavity 11. The following description of the lock 12 relates to alignments and positions that exist when the lock 12 is not deformed.

The fastening portion 13 of the lock 12 has a front edge 13F and an upper surface that extends rearwardly from the front edge 13F. The upper surface of the fastening portion 13 faces into the cavity 11. A sliding-contact surface 13*a* extends rearwardly along the upper surface of the fastening portion 13 from the front edge 13F and is substantially parallel to an inserting direction ID that extends longitudinally through the cavity 11. A guiding surface 13*b* extends along the upper surface of the fastening portion 13 behind the sliding-contact surface 13*a*. The guiding surface 13*b* is oblique to the inserting direction ID when the lock 12 and slopes down and to the back from the rear end of the sliding contact surface 13*a*. The rear end of the guiding surface 13*b* is substantially continuous with the bottom wall of the cavity 11. A slanted front surface 15 is formed at the front end of the fastening portion 13 and meets the sliding contact surface 13*a* at an acute angle along the front edge 13F of the fastening portion 13. Thus, the slanted front surface 15 is slopes down and back from the front edge 13F of the fastening portion 13.

The fastening portion 13 includes a slanted bottom surface 16 that faces the deformation permitting space 19. The slanted bottom surface 16 is cut obliquely and gradually thins the fastening portion 13 to the front. Thus, a vertical distance between the slanted bottom surface 16 of the fastening portion 13 and the bottom surface of the deformation permitting space 19 increases gradually toward the front end of the lock 12 and is at its maximum at the front end of the slanted bottom surface 16. An arcuate surface 17 extends smoothly between the slanted bottom surface 16 and the slanted front surface 15.

The jig contact portion 14 has a front edge 14F and an upper surface that extends back from the front edge 14F. A jig guiding surface 14*a* extends back from the front edge 14F along the upper surface and slopes up and to the rear from the front edge 14F. Thus, the jig guiding surface 14*a* is aligned oblique to the inserting direction JID of the withdrawing jig J. A jig sliding-contact surface 14*b* is defined on the upper surface of the jig contact portion 14 behind the jig guiding surface 14*a* and extends substantially parallel to the inserting direction JID of the withdrawing jig J. Additionally, the jig sliding-contact surface 14*b* is at substantially the same height as the lower end of the terminal guiding surface 13*b* of the fastening portion 13. The bottom surface of the jig contact portion 14 is slanted and is substantially continuous and flush with the slanted bottom surface 16 of the fastening portion 13.

The jig guiding surface 14*a* and the jig sliding-contact surface 14*b* of the jig contact portion 14 are lower than the upper surface of the sliding-contact surface 13*a* and the guiding surface 13*b* of the fastening portion 13. This height difference defines a substantially flat guiding surface 18 along a side surface of the fastening portion 13 that faces toward an insertion space 20 above the jig contact portion 14. The flat guiding surface 18 is substantially parallel to the inserting direction JID of the withdrawing jig J and substantially normal to the jig sliding-contact surface 14*b*.

The front edge 14F of the jig contact portion 14 is more backward than the front edge 13F of the fastening portion 13. Further, the jig guiding surface 14*a* and the slanted bottom surface 16 meet an acute angle defined by the front edge 14F of the jig contact portion 14.

The withdrawing jig J is narrow and long and has a substantially rectangular lateral cross section. A tapered guide J*a* is defined at the leading end of the withdrawing jig J.

The connector is assembled by mounting a front holder 22 on the front end of the housing 10. The front holder 22 has tab insertion openings 23 through which tabs (not shown) of male terminal fittings 21 can be inserted for entry into the corresponding cavities 11. The front holder 22 also has rectangular jig insertion openings 24 located above the jig contact portion 14 and corresponding to the insertion space 20 formed at the side of the fastening portion 13. Terminal fittings 21 then are inserted into the corresponding cavities 11 from behind and along the inserting direction ID. Thus, the bottom surface of each terminal fitting 21 contacts the guiding surface 13*b* of the lock 12 and deforms the lock 12 down in the deformation direction DD, due to the inclination of the terminal guiding surface 13*b*. As a result, the lock 12 enters the deformation permitting space 19. The lock 12 resiliently returns when the terminal fitting 21 reaches the proper insertion position. Consequently, the front end 13F of the fastening portion 13 engages an engaging step portion 21*a* formed on the bottom surface of the terminal fitting 21 to lock the terminal fitting 21.

The terminal fitting 21 can be withdrawn by inserting the withdrawing jig J from the front through the jig insertion opening 24 and along the jig insertion direction JID. The withdrawing jig J enters the insertion space 20 and is prevented from loose transverse movements by a sliding contact with the guiding surface 18 of the lock 12 and the side wall of the insertion space 20 (see FIG. 5). A slanted bottom surface of the guiding portion Ja of the withdrawing jig J contacts the jig guiding surface 14*a* of the jig contact portion 14 immediately after the withdrawing jig J starts entering the insertion space 20. The withdrawing jig J then slides in contact with the jig sliding-contact surface 14*b* of the jig contact portion 14 and deforms the lock 12 down in the deformation direction DD (see FIG. 6). The resiliently deformed lock 12 cancels the locked state by disengaging the fastening portion 13 from the terminal fitting 21. Thus, the terminal fitting 21 can be pulled opposite to the inserting direction ID and withdrawn from the cavity 11 while held in the unlocked state by the withdrawing jig J.

Figure 6:
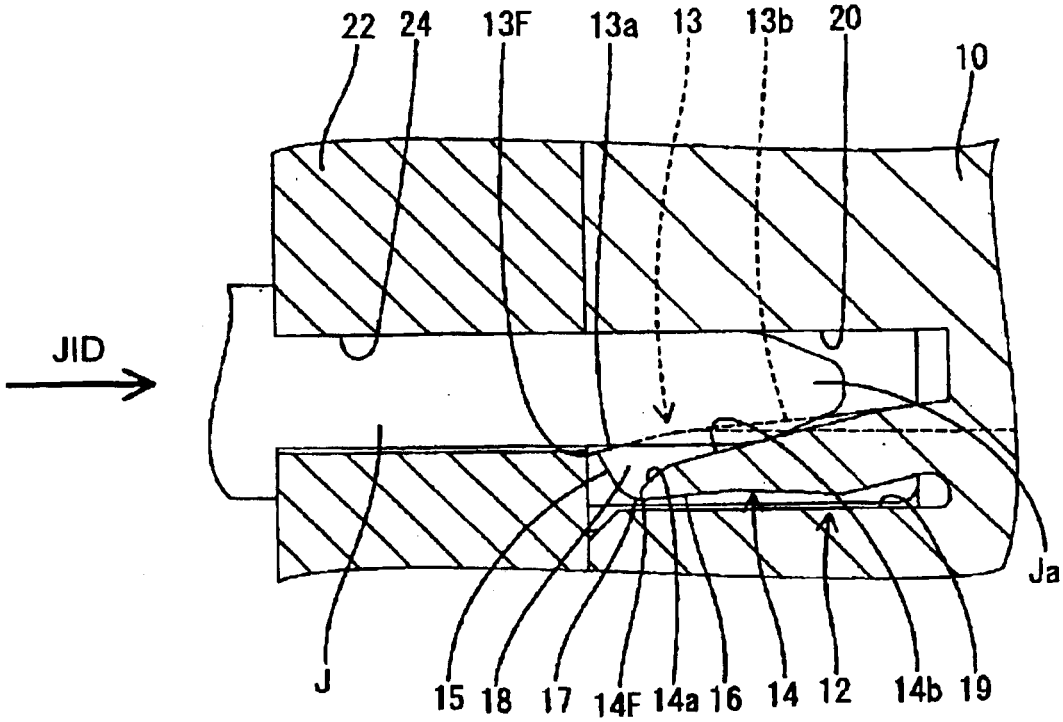
FIG. 6 is a longitudinal sectional view showing a state where the lock is resiliently deformed by the withdrawing jig.

The withdrawing jig J is prevented from loose transverse movements by the guiding surface 18 of the lock 12 and the side wall of the insertion space 20 and is prevented from loose upward movements by the upper wall of the insertion space 20. Thus, the withdrawing jig J securely deforms the lock 12 down in the deformation direction DD. Further, the slanted bottom surface 16 of the resiliently deformed lock 12 is substantially parallel to the bottom surface of the deformation permitting space 19 with a small clearance therebetween, as shown in FIG. 6.

As described above, the front edge 14F of the jig contact portion 14 of the lock 12 is more backward than the front edge 13F of the fastening portion 13. Thus, the withdrawing jig J starts sliding on the jig contact portion 14 at a later timing during the insertion of the withdrawing jig J, as compared to the case shown in FIG. 7(B) where a front edge 140F of a jig contact portion 140 is at the same position as a front end 130F of a fastening portion 130. As a result, the length of the stroke of the sliding-contact that is accompanied by frictional resistance between the withdrawing jig J and the jig contact portion 14 is shortened. That is, the insertion stroke from the start of the sliding contact of the withdrawing jig J with the jig contact portion 14 to the end of the resilient deformation of the lock 12 is shortened. Therefore, frictional resistance associated with the operation of the withdrawing jig J is reduced and operational efficiency is improved.

The fastening portion 13 projects up further than the jig contact portion 14 and the guiding surface 18 on the side of this projecting part of the fastening portion 13 guides the withdrawing jig J in the insertion space 20. The front end of the guiding surface 18 is more forward than the front edge 14F of the jig contact portion 14. Thus, the withdrawing jig J is guided by the guiding surface 18 before reaching the jig contact portion 14, and is prevented from loose lateral movements.

The slanted front surface 15 is aligned to extend down and back from the front edge 13F of the fastening portion 13. Accordingly, a withdrawing jig J that is displaced sideways from the jig contact portion 14 during insertion will strike against the slanted front surface 15 of the fastening portion 13 and will be guided away from the terminal fitting 21 by the inclination of the slanted front surface 15. Consequently, the withdrawing jig J will not contact the terminal fitting 21.

Figure 7A:
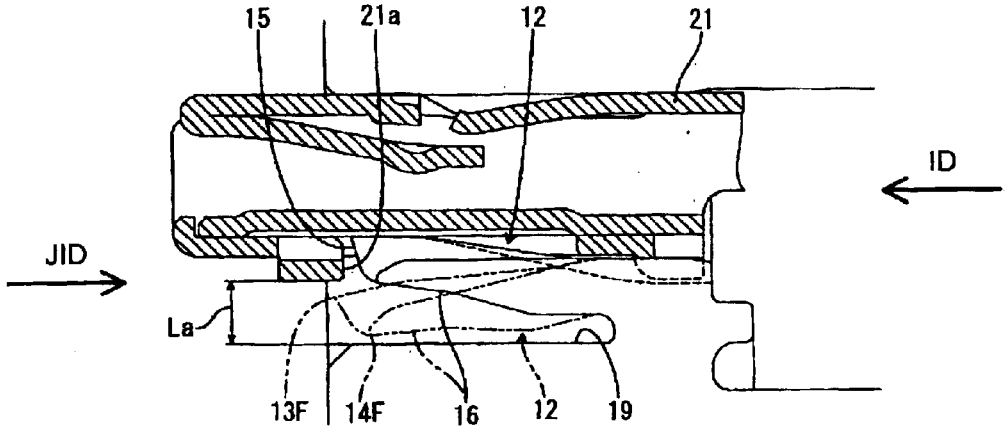
FIG. 7(A) is a longitudinal sectional view showing a state where the lock of the first embodiment is resiliently deformed to be disengaged from the terminal fitting.
Figure 7B:
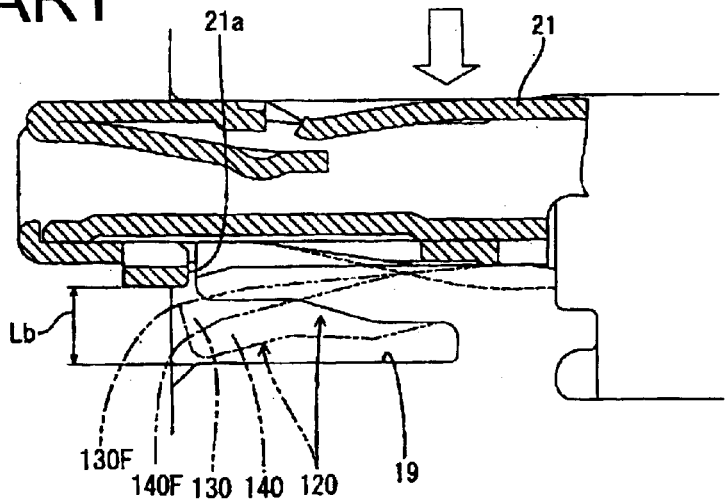
FIG. 7(B) PRIOR ART
FIG. 7(B) is a longitudinal sectional view showing a state where a prior art lock is resiliently deformed to be disengaged from the terminal fitting.

The housing 10 has the deformation permitting space 19 that permits the lock 12 to be deformed in the direction DD. The distance between the lock 12 in the free state and the bottom surface of the deformation permitting space 19 must be sufficient so that the lock 12 does not interfere with the bottom surface of the deformation permitting space 19 when the lock 12 is disengaged from the terminal fitting 21. Efficient use of space is achieved by gradually thinning the fastening portion 13 and the jig contact portion 14 toward the front. This thinning is accomplished by the slanted bottom surface 16, which is aligned so that the distance between the slanted bottom surface 16 and the bottom surface of the deformation permitting space 19 becomes greater toward the front of the lock 12. Therefore, the lock 12 can deform more even if the distance from the bottom surface of the deformation permitting space 19 to the lock 12 is smaller. In other words, a vertical dimension La from the bottommost surface of the terminal fitting 21 to the bottom surface of the deformation permitting space 19, as shown in FIG. 7(A), can be smaller than a corresponding dimension Lb in the lock 120 that has a bottom surface substantially parallel to the bottom surface of the deformation permitting space 19, as shown in FIG. 7(B). As a result, the height of the entire connector is shorter.

Second to sixth embodiments of the invention are described with reference to FIGS. 8 to 12. The lock of each of these embodiments is constructed differently from the lock 12 of the first embodiment. However, other parts of the connectors in FIGS. 8 to 12 are similar to or the same as the first embodiment. Thus, no description is given for these similar parts, and they are merely identified by the same reference numerals.

Figure 8:
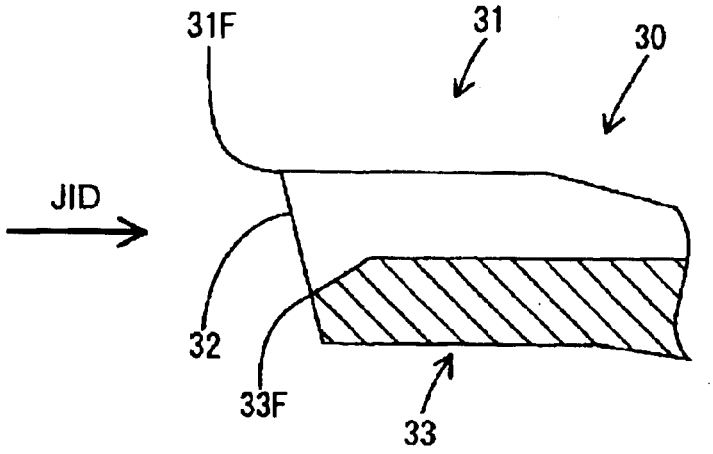
FIGS. 8 through 12 are side views partly in section of locks according to second through sixth embodiments respectively.

A lock 30 of the second embodiment is shown in FIG. 8. The lock 30 is similar to the lock 12 of the first embodiment in that a fastening portion 31 has a slanted front surface 32. Additionally, a front edge 33F of a jig contact portion 33 is more backward in the jig inserting direction JID than a front edge 31F of the fastening portion 31. However the lock 30 differs from the first embodiment in that the bottom surface of the lock 30 is substantially parallel to the inserting direction JID of the withdrawing jig J, and the front edge 33F of the jig contact portion 33 is above the lower end of the slanted surface 32.

Figure 9:
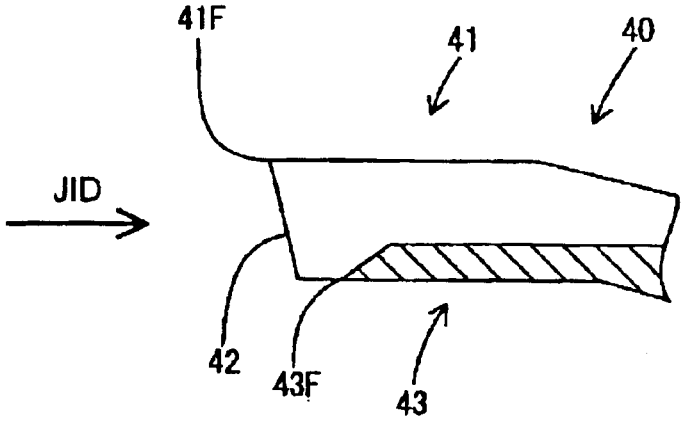

A lock 40 of the third embodiment is shown in FIG. 9. The lock 40 is similar to the lock 12 of the first embodiment in that a fastening portion 41 has a slanted front surface 42. Additionally, a front edge 43F of a jig contact portion 43 is more backward in the withdrawal jig inserting direction JID than a front edge 41F of the fastening portion 41. However, the lock 40 differs from the first embodiment in that the lower surface of the lock 40 is substantially parallel to the inserting direction JID of the withdrawing jig J, and the front edge 43F of the jig contact portion 43 is more backward in the withdrawal jig inserting direction JID than the lower end of the slanted surface 42.

Figure 10:
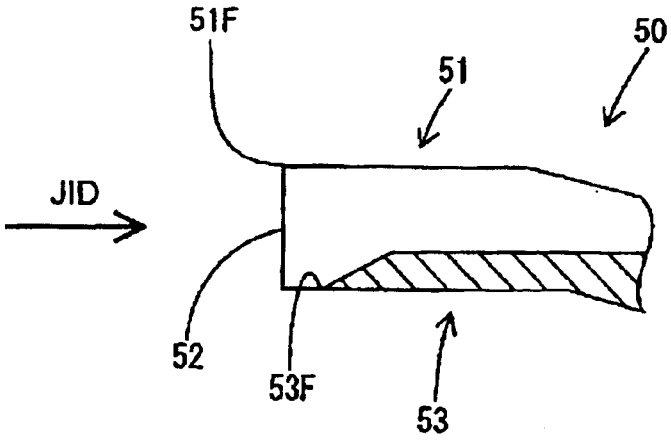

A lock 50 of the fourth embodiment is shown in FIG. 10. The lock 50 is similar to the third embodiment except that a fastening portion 51 has a substantially flat front end surface 52 aligned substantially normal to the inserting direction JID of the withdrawing jig J. The other construction (including the position of a front edge 53F of a jig contact portion 53 more backward in the withdrawal jig inserting direction JID than a front edge 51F of the fastening portion 51) is the same as the lock 40 of the third embodiment.

Figure 11:
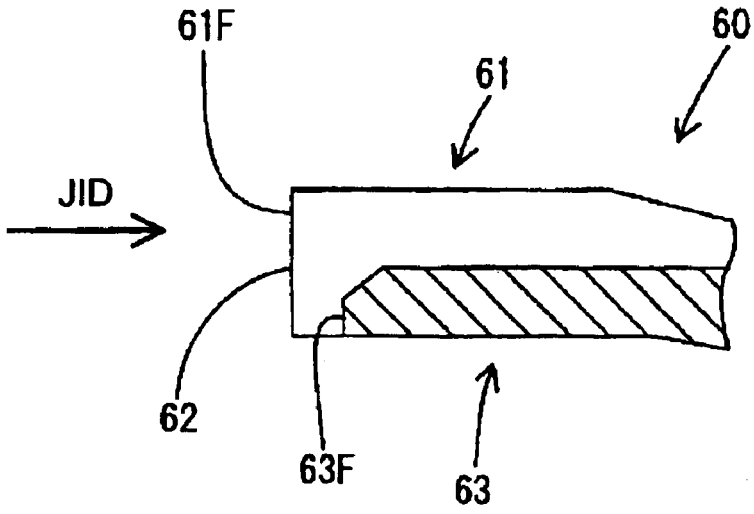

A lock 60 of the fifth embodiment is shown in FIG. 11. The lock 60 has fastening portion 61 with a front end surface 62 of a fastening portion 61 that is substantially normal to the inserting direction JID of the withdrawing jig J. Additionally, the bottom surface of the lock 60 is substantially parallel to the inserting direction JID of the withdrawing jig J. Furthermore, a front edge 63F of a jig contact portion 63 is more backward in the withdrawal jig inserting direction JID than the front end surface 62 of the fastening portion 61.

Figure 12:
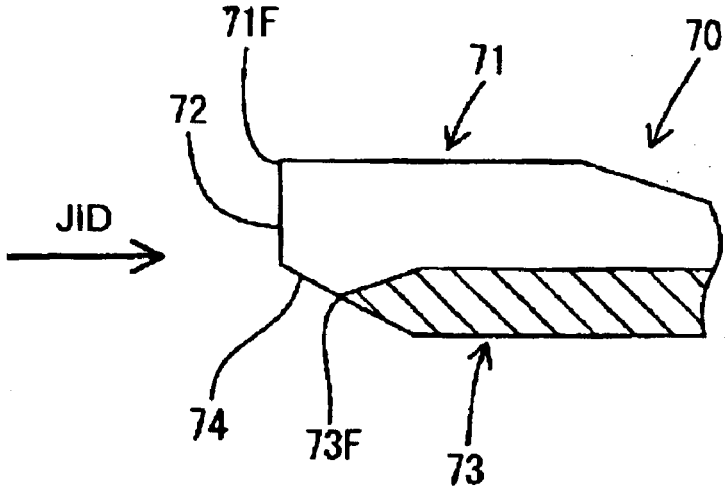

A lock 70 of the sixth embodiment is shown in FIG. 12. The lock 70 has a fastening portion 71 with a substantially flat front end surface 72 aligned substantially normal to the inserting direction JID of the withdrawing jig J. Additionally, the front end of the lock 70 has a slanted bottom surface 74 aligned oblique to the inserting direction JID of the withdrawing jig J. A front edge 73F of a jig contact portion 73 is at an intermediate position of the slanted bottom surface 74. Accordingly, the front edge 73F of the jig contact portion 73 is more backward in the jig inserting direction JID than the front end 71F of the fastening portion 71.

The invention is not limited to the above described and illustrated embodiments. For example, the following embodiments are also embraced by the technical scope of the present invention as defined in the claims. Beside the following embodiments, various changes can be made without departing from the scope and spirit of the present invention as defined in the claims.

The jig contact portion is lower than the fastening portion in the foregoing embodiments. However, the jig contact portion may be more outward than the outer side surface of the terminal fitting and higher than the fastening portion according to the present invention.

The jig contact portion is at only one side of the fastening portion in the foregoing embodiments. However, the jig contact portion may be at the left and right sides of the fastening portion. Thus, the jig can contact either one of the right and left jig contact portions.

The jig contact portion is at one side of the fastening portion in the foregoing embodiments. However, one jig contact portion may be between right and left fastening portions according to the present invention.

Although the female connector is described in the foregoing embodiments, the present invention is also applicable to male connectors accommodating male terminal fittings with tabs at their leading ends.

What is claimed is:

1. A connector, comprising:

a housing formed with at least one cavity into which at least one terminal fitting is insertable in an inserting direction;

a lock cantilevered substantially in the inserting direction along an inner wall of the cavity and being resiliently deformable in a deformation direction to exit an insertion path for the terminal fitting, a fastening portion at an end of the lock for engaging and locking the terminal fitting from a withdrawing side;

at least one jig contact portion in proximity to the fastening portion of the lock for sliding contact with a withdrawing jig inserted into the housing from a jig inserting direction so that the withdrawing jig deforms the lock in the deformation direction to be disengaged from the terminal fitting, the jig contact portion projecting from the fastening portion in a direction transverse to the deforming direction; and a distal end of the jig contact portion being spaced from a distal end of the fastening portion along the jig insertion direction.

2. The connector of claim 1, wherein the fastening portion projects farther in a direction opposite to the deforming direction than the jig contact portion to define a projecting part, and a guiding surface defined on a side surface of the projecting part of the fastening portion adjacent the jig contact portion for guiding the withdrawing jig onto the jig contact portion.

3. The connector of claim 1, wherein the fastening portion has a slanted end surface sloped to extend more backward from a locking end toward the distal end of the jig contact portion.

4. The connector of claim 1, wherein the housing is formed with a deformation permitting space for permitting the lock to be deformed in the deformation direction to be disengaged from the terminal fitting.

5. A connector, comprising:

a housing formed with at least one cavity into which at least one terminal fitting is insertable in an inserting direction, a deformation permitting space defined substantially adjacent the cavity;

a lock cantilevered substantially in the inserting direction along an inner wall of the cavity and disposed between the cavity and the deformation permitting space, the lock being resiliently deformable in a deformation direction to exit an insertion path for the terminal fitting and to enter the deformation permitting space, a fastening portion at an end of the lock for engaging and locking the terminal fitting from a withdrawing side;

at least one jig contact portion in proximity to the fastening portion of the lock for sliding contact with a withdrawing jig inserted into the housing from a jig inserting direction so that the withdrawing jig deforms the lock in the deformation direction to be disengaged from the terminal fitting;

a distal end of the jig contact portion being spaced from a distal end of the fastening portion along the jig insertion direction; and wherein the lock has a slanted surface facing the deformation permitting space and aligned such that the fastening portion and the jig contact portion gradually thin toward the end of the lock.

6. The connector of claim 5, wherein the distal end of the jig contact portion is substantially at the same position as that of the slanted surface, the distal end portion of the jig guiding surface and that of the slanted surface meet to form an acute angle.

7. A connector, comprising:

a housing formed with at least one cavity into which at least one terminal fitting is insertable in an inserting direction;

a lock cantilevered substantially in the inserting direction along an inner wall of the cavity and being resiliently deformable in a deformation direction to exit an insertion path for the terminal fitting, a fastening portion at an end of the lock for engaging and locking the terminal fitting from a withdrawing side;

at least one jig contact portion in proximity to the fastening portion of the lock for sliding contact with a withdrawing jig inserted into the housing from a jig inserting direction so that the withdrawing jig deforms the lock in the deformation direction to be disengaged from the terminal fitting; and a distal end of the jig contact portion being spaced from a distal end of the fastening portion along the jig insertion direction, and wherein the fastening portion and the jig contact portion have widths with a sum that exceeds a width of the cavity.

8. A connector, comprising:

a housing with opposite front and rear ends and cavities extending between the ends, deformation permitting spaces extending rearwardly in the housing substantially adjacent the cavities; and locks cantilevered forwardly in the housing at locations between the respective cavities and the deformation permitting spaces, the locks being resiliently deformable in a deformation direction away from the cavities and into the deformation permitting spaces, each said lock having an end, a fastening portion with a distal end at an end of the lock, at least one jig contact portion in proximity to the fastening portion of the lock, the jig contact portion having a distal end spaced rearwardly from the distal end of the fastening portion, the jig contact portion projecting in a direction transverse to the deforming direction on a side of and adjacent to the fastening portion of the respective lock.

9. The connector of claim 8, wherein the fastening portion projects further from the deformation permitting space than the jig contact portion to define a projecting part, and a guiding surface defined on a side surface of the projecting part of the fastening portion.

10. The connector of claim 8, wherein the fastening portion has a slanted front end surface sloped to extend back into the deformation permitting space.

11. A connector, comprising:

a housing with opposite front and rear ends and cavities extending between the ends, deformation permitting spaces extending rearwardly in the housing substantially adjacent the cavities; and locks cantilevered forwardly in the housing at locations between the respective cavities and the deformation permitting spaces, the locks being resiliently deformable in a deformation direction away from the cavities and into the deformation permitting spaces, each said lock having an end, a fastening portion with a distal end at an end of the lock, at least one jig contact portion in proximity to the fastening portion of the lock, the jig contact portion having a distal end spaced rearwardly from the distal end of the fastening portion wherein each of the locks has a slanted surface facing the deformation permitting space and aligned such that the fastening portion and the jig contact portion gradually thin toward the front end of the housing.

12. The connector of claim 11, wherein the jig guiding surface and the slanted surface meet to form an acute angle edge.

* * * * *